US005458109A

United States Patent [19]

Tu

[11] Patent Number: 5,458,109

[45] Date of Patent: Oct. 17, 1995

[54] BARRETTE

[76] Inventor: Jui M. Tu, No. 200-1, Sec. 1 Chung Hwa Rd., Tainan, Taiwan

[21] Appl. No.: 154,783

[22] Filed: Nov. 18, 1993

[51] Int. Cl.[6] ..... A45D 8/22

[52] U.S. Cl. ..... 132/279; 132/278

[58] Field of Search ..... 132/279, 278, 132/275, 273

[56] References Cited

U.S. PATENT DOCUMENTS

| | | | |
|---|---|---|---|
| 931,877 | 8/1909 | Kingman | 132/279 |
| 1,032,353 | 7/1912 | Machate | 132/278 |
| 1,039,910 | 10/1912 | Degenhardt | 132/275 |
| 1,243,834 | 10/1917 | Hamilton | 132/278 |
| 1,377,408 | 5/1921 | Dies | 132/283 |
| 1,516,661 | 11/1924 | Bechtold | 132/279 |
| 1,529,378 | 3/1925 | Seymore | 132/260 |
| 2,475,998 | 7/1949 | Soergel | 28/42 X |
| 2,598,943 | 6/1952 | Solomon | 132/248 |
| 2,931,368 | 4/1960 | Fulton | 132/283 |
| 2,998,015 | 8/1961 | Gresham et al. | 132/279 |

FOREIGN PATENT DOCUMENTS

| | | | |
|---|---|---|---|
| 418615 | 12/1910 | France | 132/278 |
| 520467 | 2/1921 | France | 132/279 |
| 624164 | 7/1927 | France | 132/279 |
| 805427 | 5/1951 | Germany | 132/279 |
| 280682 | 5/1952 | Switzerland | 132/279 |
| 121213 | 6/1927 | U.S.S.R. | 132/278 |
| 14580 | of 1903 | United Kingdom | 132/279 |

*Primary Examiner*—John G. Weiss

*Attorney, Agent, or Firm*—Harness, Dickey & Pierce

[57] ABSTRACT

A barrette for releasably capturing strands of hair when in a closed operative condition is provided. This barrette has a pair of elongated members which are coupled to one another for movement between a closed operative condition where the elongated members are juxtaposed and define an opening therebetween for releasably capturing strands of hair, and an open condition where the elongated members are at least partially separated from one another. One of the elongated members has a plurality of separating members that extend toward the other elongated member when in a closed operative condition. These separating members are operable for separating the strands of hair captured between the two elongated members.

16 Claims, 3 Drawing Sheets

BARRETTE

BACKGROUND AND SUMMARY

This invention relates generally to barrettes and, more particularly, to barrettes having a plurality of hair separating members.

Generally, barrettes or "hair slides" are decorative clips which are used to retain braided or gathered strands of hair. Typically, a barrette includes an outer decorative member that is pivotally coupled to an inner locking clip. As is well known, this type of barrette is placed over the strands of hair such that the outer decorative member is outwardly exposed and the locking clip is tucked underneath. The locking clip and outer member are then pivoted to a closed position such that the strands of hair are clampingly engaged between the outer decorative member and the locking clip. Accordingly, the barrette is held in place upon the strands of hair and serves not only as a device for holding the strands of hair, but also as a fashion item which enhances the appearance of its user.

In the never ending search for new and improved fashionable hair accessories, a wide variety of barrettes have been developed and marketed. Nevertheless, the fashion industry is constantly attempting to come up with new and unique barrette designs which are less costly to manufacture and easier to assemble and use. In an attempt to meet these desirable criteria, the present invention provides a simplified yet novel barrette design which incorporates a pair of uniquely configured elongated members. One of the elongated members has a plurality of hair separating members and is coupled to the other elongated member for movement between an open condition and a closed operative condition. When in an open condition, strands of hair are readily placed between the elongated members. Thereafter, the elongated members are articulated to the closed operative condition where the hair separating members divide the strands of hair captured therein. As such, the strands of hair are separated giving the hair itself a unique and aesthetically pleasing appearance while the fashionable barrette enhances the aesthetic appearance of the user.

DETAILED DESCRIPTION OF THE DRAWINGS

Additional objects, advantages, and features of the present invention will become apparent from the following description and appended claims, taken in conjunction with the accompanying drawings in which:

DETAILED DESCRIPTION OF THE PREFERRED EMBODIMENT

Figure 1:
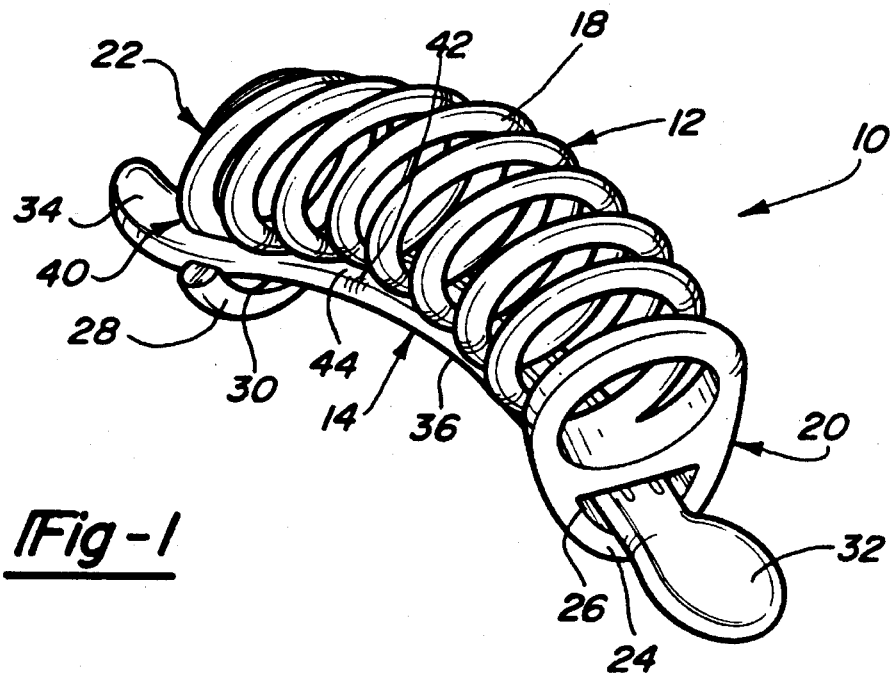
FIG. 1 is a perspective view of the barrette of the present invention illustrated in a closed operative condition.
Figure 8:
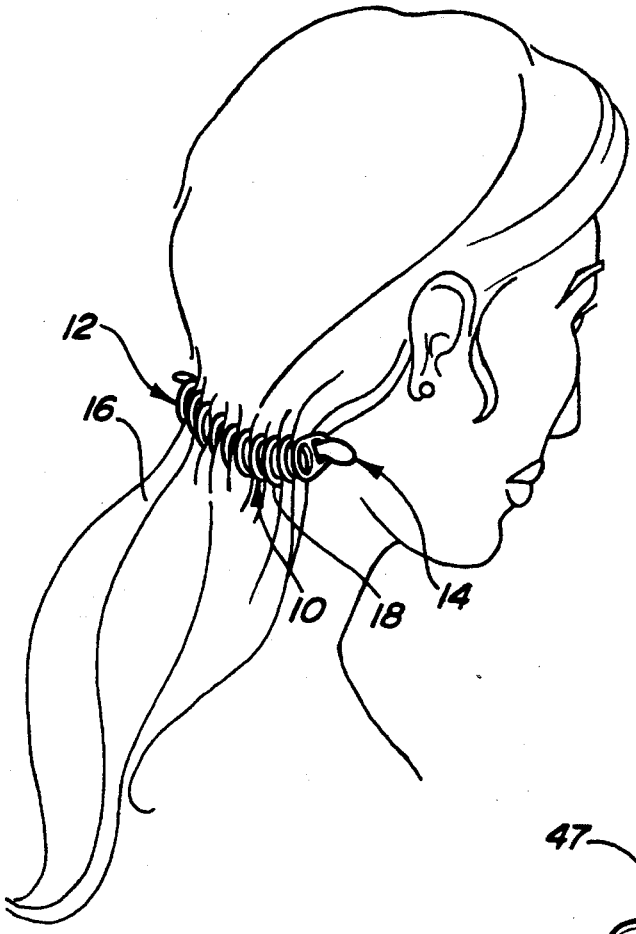
FIG. 8 is a perspective view of the barrette in a closed operative condition, engaged with strands of hair in accordance with the principles of the present invention.
Figure 10:
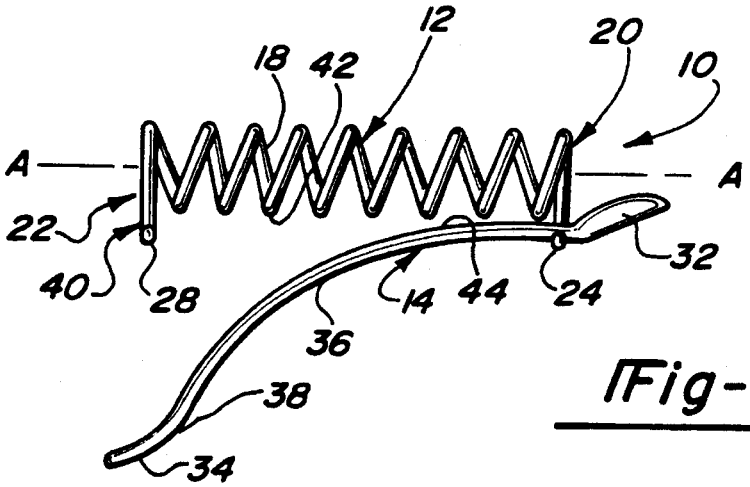
FIG. 10 is a perspective view similar to FIG. 2 illustrating the barrette of the present invention in an open condition.

Referring now to the drawings and in particular to FIG. 1, the barrette 10 of the present invention is shown. As is shown, this particular barrette 10 has a unique two-part construction including an elongated helical member 12 that is relatively flexible and an elongated arcuate member 14 that is relatively rigid. As best shown in FIGS. 1 and 10, these elongated members 12 and 14 are coupled to one another for movement between a closed operative condition as shown in FIG. 1, and an open condition shown in FIG. 10. When in the open condition, the helical member 12 is simply placed over the strands of hair 16 such that the helical member 12 is oriented generally perpendicular to the strands of hair 16 and is outwardly exposed. Thereafter, the arcuate member 14 is articulated to the position shown in FIG. 1 such that the barrette 10 is in a closed operative condition. Accordingly, as shown in FIG. 8, the strands of hair 16 are releasably captured and separated by the individual coils 18 of the helical member 12, thereby providing a unique aesthetic appearance to the strands of hair 16.

In the embodiment shown in FIGS. 1–7 and 10, the helical elongated member 12 has first and second ends 20 and 22 respectively. Preferably, the first end 20 includes an integrally extending ear 24 which defines an aperture 26 therein, and the second end 22 includes an integrally extending finger 28 which defines an open ended recess 30 between the finger 28 and one of the coils 18. The elongated arcuate member 14, on the other hand, is formed with an enlarged end 32, a narrow end 34, and a generally continuous and intermediate arcuate portion 36 extending therebetween. The arcuate member 14 and the helical member 12 are coupled to one another by sliding the narrow end 34 of the arcuate member 14 through the aperture 26, as can be envisioned by viewing FIGS. 1 and 10. The arcuate member 14 is slid through the aperture 26 until the enlarged end 32 of the arcuate member 14 engages the portion of the ear 24 which defines the aperture 26. The enlarged portion 32 of the arcuate member 14 has a width greater than the width of the aperture 26 such that the arcuate member 14 is prevented from sliding completely through the aperture 26. Once the arcuate member 14 is fully inserted into the aperture 26, assembly of the barrette 10 is complete.

Figure 2:
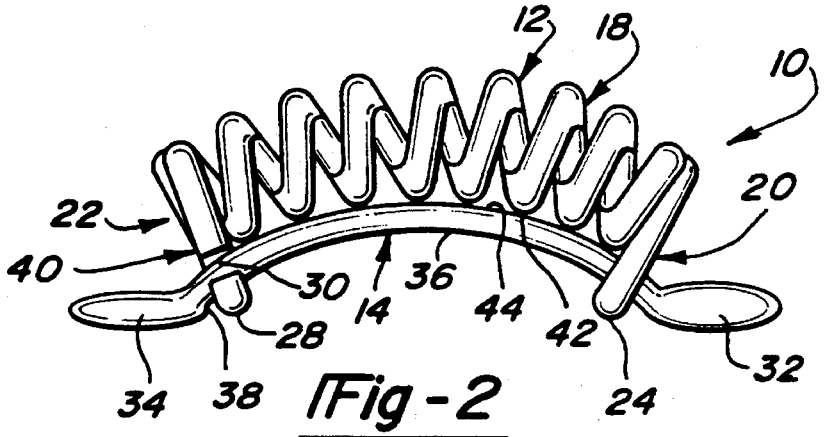
FIG. 2 is a front view of the barrette of the present invention in a closed operative condition.
Figure 3:
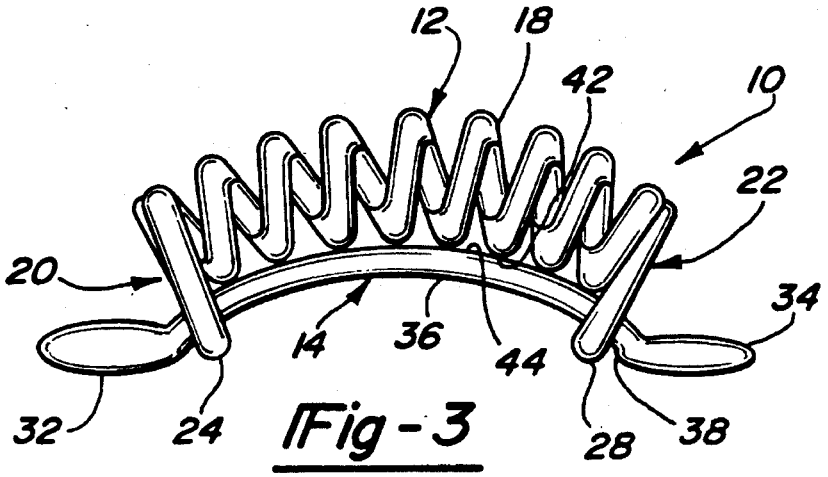
FIG. 3 is rear view of the barrette of the present invention in a closed operative condition.
Figure 7:
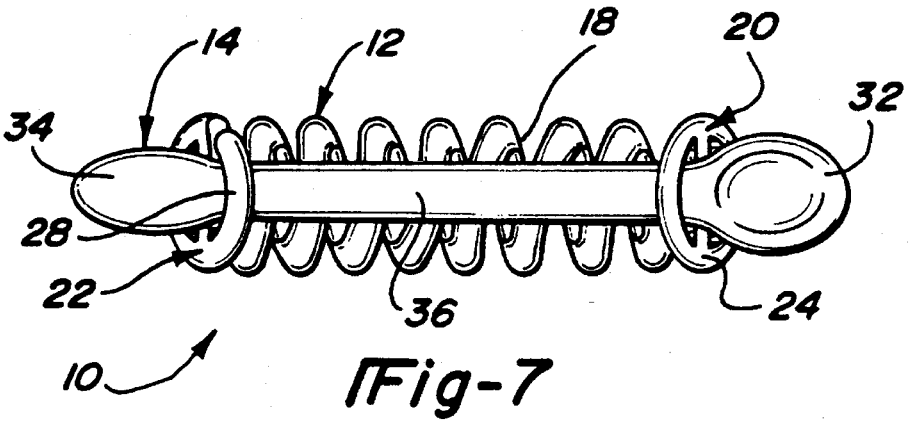
FIG. 7 is a bottom view of the barrette of the present invention illustrated in a closed operative condition.

As best shown in FIGS. 2, 3 and 7, the narrow end 34 of the arcuate member 14 defines a shoulder 38 where the narrow end 34 and the intermediate arcuate portion 36 meet. This shoulder 38 serves the purpose of preventing the arcuate member 14 from sliding out of either the recess 30 or the aperture 26 at either end 20 or 22 of the helical member 12. In other words, when in an operative condition, this shoulder 38 abuttingly engages the finger 28, as shown in FIGS. 2 and 3 such that the arcuate member 14 is prevented from sliding longitudinally and being withdrawn from the recess 30. Additionally, when the barrette 10 is in an open condition, this shoulder 38 will abuttingly engage the ear 24 extending from the first end 20 of the helical member 12, thereby preventing the narrow end 32 of the arcuate member 14 from readily slipping through the aperture 26 and becoming separated from the helical member 12. While the narrow end 34 of the arcuate member 14 can be slipped through both the recess 30 and the aperture 26 when properly oriented, the shoulder 38 will generally catch and prevent the narrow end 34 from slipping through during normal handling of the barrette 10. Thus, while the arcuate member 14 and the helical member 12 can be easily assembled and disassembled by properly orienting the narrow end 34 of the arcuate member 14 and forcing it through the aperture 26, the shoulder 38 acts as a barb and prevents the arcuate member 14 from accidentally slipping through the recess 30 or the aperture 26.

Figure 4:
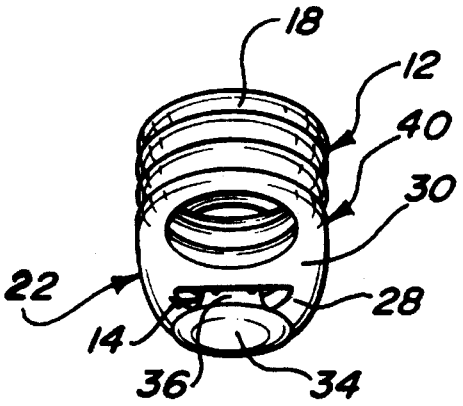
FIG. 4 is an end view of the barrette of the present invention illustrating one end of the arcuate member in a closed operative condition.

Once assembled, the barrette 10 is readily articulated between the closed operative condition shown in FIG. 1 and the open condition shown in FIG. 10. In order to place the barrette 10 in a closed operative condition, the arcuate member 14 is simply articulated from its open position in FIG. 10 to a position such that the narrow end 34 of the arcuate member 14 is adjacent to the mouth 40 of the recess 30 in the second end 22 of the helical member 12. The mouth 40 of the recess 30 has an opening which is narrower than the thickness of the intermediate arcuate portion 36 of the arcuate member 14. In addition, the mouth 40 of the recess 30 is tapered to ease insertion of the arcuate member 14 into the recess 30 and provide a camming effect upon the finger 28 such that it readily deflects. As such, the arcuate member 14 is inserted into the recess 30 by forcing the intermediate arcuate portion 36 into the mouth 40, thereby deflecting the finger 28 slightly such that the mouth 40 opens and permits the intermediate arcuate portion 36 to slide into the recess 30. As shown in FIG. 4, once the arcuate member 14 passes through the mouth 40 of the recess 30, the recess 30 becomes wider than the thickness of the intermediate arcuate portion 36, permitting the finger 28 to relax from its deflected position.

As can be seen in FIG. 10, when the barrette 10 is initially in the open condition, the helical member 12 is relaxed and extends along a linear longitudinal axis A-A. However, when in a closed operative condition, as shown in FIGS. 2 and 3, an inner surface 42 of the helical member 12 engages an inner surface 44 of the intermediate arcuate portion 36 causing the helical member 12 to flex and follow the curvature of the intermediate arcuate portion 36. As a result, the helical member 12 is stressed urging the helical member 12 to return to its relaxed linear state. This stress imposes loads between the arcuate member 14 and the helical member 12 which serve the dual purpose of maintaining the barrette 10 in a locked operative condition and forcing any strands of hair 16 captured therein to be separated and forced between the individual coils 18 of the helical member 12. Thus, no special effort is necessary on the part of the user to individually separate the strands of hair 16 before the barrette 10 is placed over the hair 16 and locked in an operative condition. Rather, the force generated between the helical member 12 and the arcuate member 14 is sufficient to automatically force the strands of hair 16 between the individual coils 18 which act as hair separating members.

Figure 6:
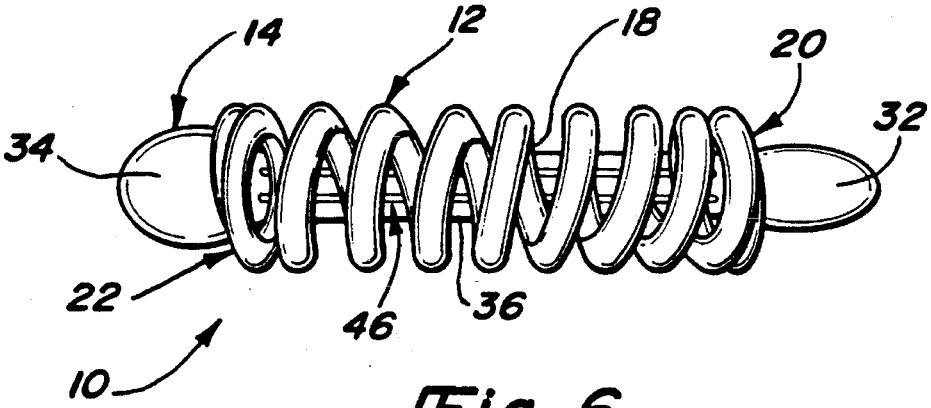
FIG. 6 is a top view of the barrette of the present invention illustrated in a closed operative condition.

The force between the arcuate member 14 and the helical member 12 not only causes the strands of hair 16 to separate between the individual coils 18, it also effectively holds the barrette 10 in place upon the strands of hair 16. As shown in FIG. 6, to assist this holding strength, grooves or other gripping members 46 may be used on the inner surface 44 of the intermediate arcuate portion 36 to engage the strands of hair 16. In other words, when strands of hair 16 are clamped between the arcuate member 14 and the helical member 12, grooves or other gripping members 46 on the inner surface 44 of the arcuate member 14 are forced into engagement with the hair 16, enhancing the gripping strength of the barrette 10.

Figure 9:
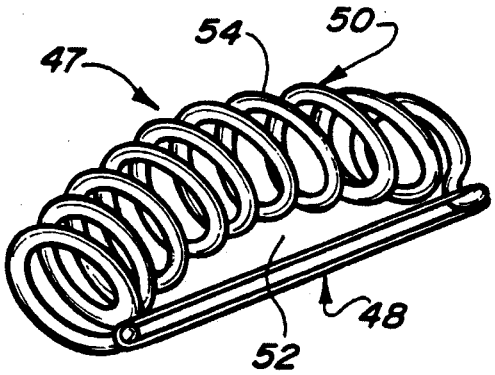
FIG. 9 is a perspective view of an alternative embodiment of the present invention illustrating an elongated helical member having an elastic band attached thereto for releasably capturing strands of hair between the band and the elongated helical member.

FIG. 9 illustrates an alternative embodiment of a barrette 47 of the present invention which utilizes an elastic band 48 rather than an elongated rigid arcuate member 14. With this particular embodiment, strands of hair 16 are gathered into a pony tail, braid or the like, and the helical member 50 is placed over the hair 16, using the elastic band 48 like a pony tail holder. In other words, the strands of hair 16 are pulled through the opening 52 between the helical member 50 and the elastic band 48. Note, it may be necessary to double the elastic band 48 in order to ensure that the strands of hair 16 are properly engaged with the helical member 50. In any event, like the previously described embodiment, the force of the elastic band 48 against the strands of hair 16 causes the strands of hair 16 to be separated and forced between the individual coils 54 of the helical member 50. Again, this provides a unique aesthetically enhanced appearance to the hair 16 while simultaneously providing the user with the fashionable look of an ornamental barrette 47.

Figure 5:
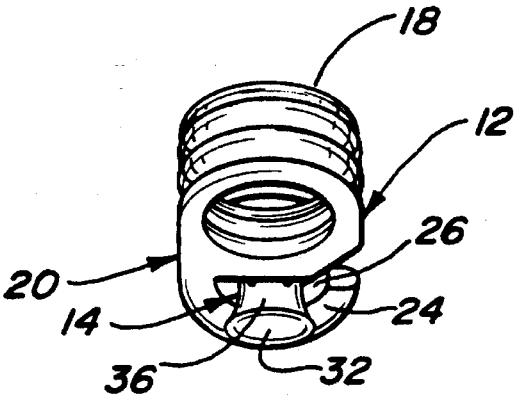
FIG. 5 is an end view of the barrette shown in FIG. 4 illustrating the opposite end of the arcuate member in a closed operative condition.

As illustrated in FIGS. 1–7 and 10, the helical elongated member 12 and the arcuate elongated member 14 are coupled to one another in a manner that facilitates a simplified manufacturing process for producing the barrette 10 and for assembling and using the barrette 10. For example, as shown in FIGS. 4 and 5, the finger 28 extending from the second end 22 of the helical member 12 which forms the recess 30 can be created by simply forming an ear and aperture identical to the ear 24 and aperture 26 at the first end 20 of the helical member 12. Thereafter, a notch can be cut through the side of the ear thereby opening the aperture and creating the recess 30. With this design, either end of the helical member 12 can be notched to create the recess 30 and the common design at both ends 20 and 22 of the helical member 12 eliminates the need for separate individual designs at both ends 20 and 22. Moreover, the two elongated members 12 and 14 can be independently manufactured by a number of conventional processes such as stamping, molding, cold forming or the like. Preferably, both the arcuate member 14 and the helical member 12 are molded from a plastic material, however, other flexible materials such as metal or the like may be utilized in various processes.

In short, the barrette 10 of the present invention utilizes a simplified two-piece design which can be easily manufactured, assembled and used. Moreover, the barrette 10 of the present invention is designed to clampingly engage the strands of hair 16 such that the barrette 10 is firmly held in place and will not slide upon the strands of hair 16 and such that the hair 16 is separated and forced between the individual coils 18 of the helical member 12. As a result, this very practical design provides not only a fashionable hair accessory for the user, but also provides an enhanced aesthetic appearance to the strands of hair 16 themselves.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

I claim:

1. A hair gathering apparatus comprising:

an elongated helical member and a base member, said elongated helical member and said base member being operatively connected for movement between a closed condition and an open condition, said elongated helical member having a longitudinal axis and being adapted for receiving a plurality of strands of hair which extend generally perpendicular to said longitudinal axis such that said strands of hair are divided by said elongated helical member, said elongated helical member further having first and second ends, said first end defining an aperture therein and said second end defining a recess therein, said base member spanning at least a portion of said elongated helical member and adapted to releasably capture said strands of hair between said base member and said elongated helical member, said base member comprising an elongated relatively rigid member which extends through said aperture such that a distal end of said elongated rigid member releasably engages said recess.

2. The hair gathering apparatus of claim 1, wherein said base member is directly connected to said elongated helical member.

3. The hair gathering apparatus of claim 1 wherein said elongated relatively rigid member has an enlarged portion at one end thereof such that when said elongated relatively rigid member is inserted into said aperture, said enlarged portion engages walls within said elongated helical member defining said aperture such that said elongated relatively rigid member is prevented from passing completely through said aperture.

4. The hair gathering apparatus of claim 1 wherein a distal end of said elongated relatively rigid member defines a shoulder thereon.

5. The hair gathering apparatus of claim 1 wherein said helical member is relatively flexible.

6. A barrette for releasably capturing strands of hair, said barrette comprising a helical member and a base member directly coupled to one another by coupling means, said coupling means providing for relative movement of said helical member and said base member between a closed operative condition where said helical member and said base member are juxtaposed and define an opening therebetween for releasably capturing said strands of hair, and an open condition where said helical member and said base member are at least partially separated from one another, said base member having a generally continuous surface and said helical member having a plurality of hair separating members which extend toward said continuous surface for dividing said opening into a plurality of individual openings and separating said strands of hair captured therebetween, said helical member having first and second ends, said first end defining a recess therein and said second end defining an aperture therein, said base member operable for passing through said aperture and releasably engaging said recess.

7. The barrette of claim 6 wherein said helical member is relatively flexible.

8. The barrette of claim 7 wherein said base member has an enlarged portion which engages walls of said first end defining said aperture such that said base member is prevented from completely passing through said aperture.

9. The barrette of claim 6 wherein said hair separating members extend generally perpendicularly from said base member.

10. An improved locking mechanism for a barrette that releasably captures gathered strands of hair, said improvement comprising:

a) a helical member for partially surrounding gathered strands of hair, one portion of said helical member having an opening defined therein, another portion of said helical member, longitudinally spaced from said one portion, defining a recess; and b) a base member which, in combination with said helical member, surrounds said gathered strands of hair, said base member having one end adapted to insert into said opening in said helical member and an opposite end that prevents said base member from passing completely through said opening, said base member further having a portion for engaging said recess in said helical member such that said base member extends between the portions of said helical member that define said opening and said recess, said base member being releasably and directly attached to said helical member.

11. The improved locking mechanism of claim 10 wherein said said member is arcuate.

12. The improved locking mechanism of claim 10 wherein said base member and said helical member are operatively associated with one another for biasing said base member against said helical member such that said portion of said base member for engaging said recess in said helical member is loaded against said portion of said helical member defining said recess, thereby preventing said portion of said base member from inadvertently disengaging said recess.

13. The improved locking mechanism of claim 10 wherein said portion of said base member for engaging said recess in said helical member is adjacent to said end of said base member adapted to insert into said opening in said helical member.

14. The improved locking mechanism of claim 10 wherein said helical member is a decorative member that is outwardly exposed upon said strands of hair for providing an ornamental appearance to said barrette.

15. The improved locking mechanism of claim 10 wherein said base member is pivotally disposed within said opening defined within said helical member such that said base member can be pivoted into and out of engagement with said recess defined within said helical member.

16. The improved locking mechanism of claim 10 wherein said portion of said helical member defining said opening is a tab extending from said helical member having an opening therethrough and said portion of said helical member defining said recess is a tab having an opening therethrough with a portion of said tab removed to form said recess.

* * * * *